United States Patent [19]

Hilgarth

[11] Patent Number: 4,979,320

[45] Date of Patent: Dec. 25, 1990

[54] ADJUSTMENT MECHANISM FOR SKIING BOOTS

[75] Inventor: Kurt Hilgarth, Graz, Austria

[73] Assignee: Skischuhfabrik Dynafit Gesellschaft m.b.H., Graz, Austria

[21] Appl. No.: 386,406

[22] Filed: Jul. 28, 1989

[30] Foreign Application Priority Data

Aug. 1, 1988 [AT] Austria ..... 1939/88

[51] Int. Cl.[5] ..... A43B 5/04

[52] U.S. Cl. ..... 36/120; 36/117

[58] Field of Search ..... 36/117, 118, 119, 120, 36/121

[56] References Cited

U.S. PATENT DOCUMENTS

| | | | |
|---|---|---|---|
| 4,581,831 | 4/1986 | Kirsch | 36/119 |
| 4,658,517 | 4/1987 | Miyoshi et al. | 36/121 X |
| 4,667,424 | 5/1987 | Sartor et al. | 36/121 X |
| 4,677,771 | 7/1987 | Arieh et al. | 36/121 X |
| 4,769,930 | 9/1988 | Morell et al. | 36/117 |
| 4,809,448 | 3/1989 | Tonel et al. | 36/120 |

FOREIGN PATENT DOCUMENTS

| | | | |
|---|---|---|---|
| 561031 | 4/1975 | Austria . | |
| 384153 | 10/1987 | Austria . | |
| 385882 | 5/1988 | Austria . | |
| 226857 | 7/1987 | European Pat. Off. | 36/119 |
| 3822380 | 1/1989 | Fed. Rep. of Germany | 36/119 |
| 3726909 | 2/1989 | Fed. Rep. of Germany | 36/117 |
| 2590129 | 5/1987 | France | 36/119 |
| 2617021 | 12/1988 | France | 36/117 |

*Primary Examiner*—Paul T. Sewell
*Assistant Examiner*—Andrew D. Meyers
*Attorney, Agent, or Firm*—Fleit, Jacobson, Cohn, Price, Holman & Stern

[57] ABSTRACT

Means for adjusting the freedom of movement between the instep shield (2) and the tip (1') of a shell (1) for skiing boots having a shell (1) which accommodates the foot and is covered on top by such shield (2). The shield is movable in relation to the shell (1) in the direction of walking and at its front rim (21) is supported on a resilient cushion (6) e.g. of rubber fitted to the boot tip (1'), following the arcuate shape thereof. In the transverse central region of the cushion (6) a slider (11), taking the form of a double-armed toggle lever and which is adjustable in the walking direction, is provided. It limits the adjustment range of the shield (2) and comprises a ratchet device which, biased by a spring engages into a matching ratchet formation of a guide in any selected position.

5 Claims, 3 Drawing Sheets

ADJUSTMENT MECHANISM FOR SKIING BOOTS

BACKGROUND OF THE INVENTION AND PRIOR ART

The invention relates to a means for adjusting the freedom of movement between the instep shield and the tip of a shell for skiing boots having a shell which accommodates the foot and is covered on top by such shield which is movable in relation to the shell in the direction of walking and at its front rim is supported on a resilient cushion, e.g. of rubber, a member which limits the movement of the shield being provided between a stop member connected to the shield and a stop member on the tip of the shell.

In known skiing boots of this type the shield is guided on both sides of the foot in short longitudinal slots of the shell and may include a front part of the collar of a conventional dual component shaft of a skiing boot intended for entering from the rear and be clamped together by means of a rearwardly pivotal cover of the shaft. In such skiing boots the degree of movement of the shield in relation to the shell affects the guidance given to the ski and the hardness of the skiing boot as experienced by the skier. Accordingly, the skier desires to be able to adjust the hardness of the boot depending on snow conditions and running conditions.

BRIEF GENERAL DESCRIPTION OF THE INVENTION

This object is attained according to the invention in a skiing boot as defined in the introduction in that the aforesaid component is a slider mounted adjustably in a plurality of, but not less than two positions in the direction of walking in the boot tip and finds support in the terminal position of the shield against the front rim thereof.

According to a further feature of the invention, the slider is provided in the central region of the boot tip. In this manner a central application of force into the boot tip is attained. However, it is also possible to provide the slider off-centre in case a positive guidance is required.

Preferably the guide is provided with apertures, slots or like catch means, spaced apart in the direction of walking, adapted for projections or like components of the slider to engage therein.

Finally, according to a further feature of the invention, the slider is pivotal about a lower edge of a chamfer formation, step or the like in relaton to the guide means and is loaded by a spring which biases the slider into the engaged position.

BRIEF DESCRIPTION OF THE DRAWINGS

Further details of the invention will be further explained with reference to the drawings in which a working example of an embodiment of the invention is illustrated. There is shown in FIG. 1, a skiing boot in perspective view, FIG. 2, a longitudinal section of the skiing boot in the region of the slider along the line II—II of FIG. 1 with the slider engaged in the position "soft" on a larger scale, FIG. 3, a section similar to FIG. 2 with the slider disengaged, FIG. 4, a similar section as in FIG. 2 with the slider engaged in the position "hard", FIG. 5, a plan view of the base plate of the guide for the slider and FIG. 6, a side elevation of the former.

DESCRIPTION OF SPECIFIC EMBODIMENT OF THE INVENTION

Figure 1:
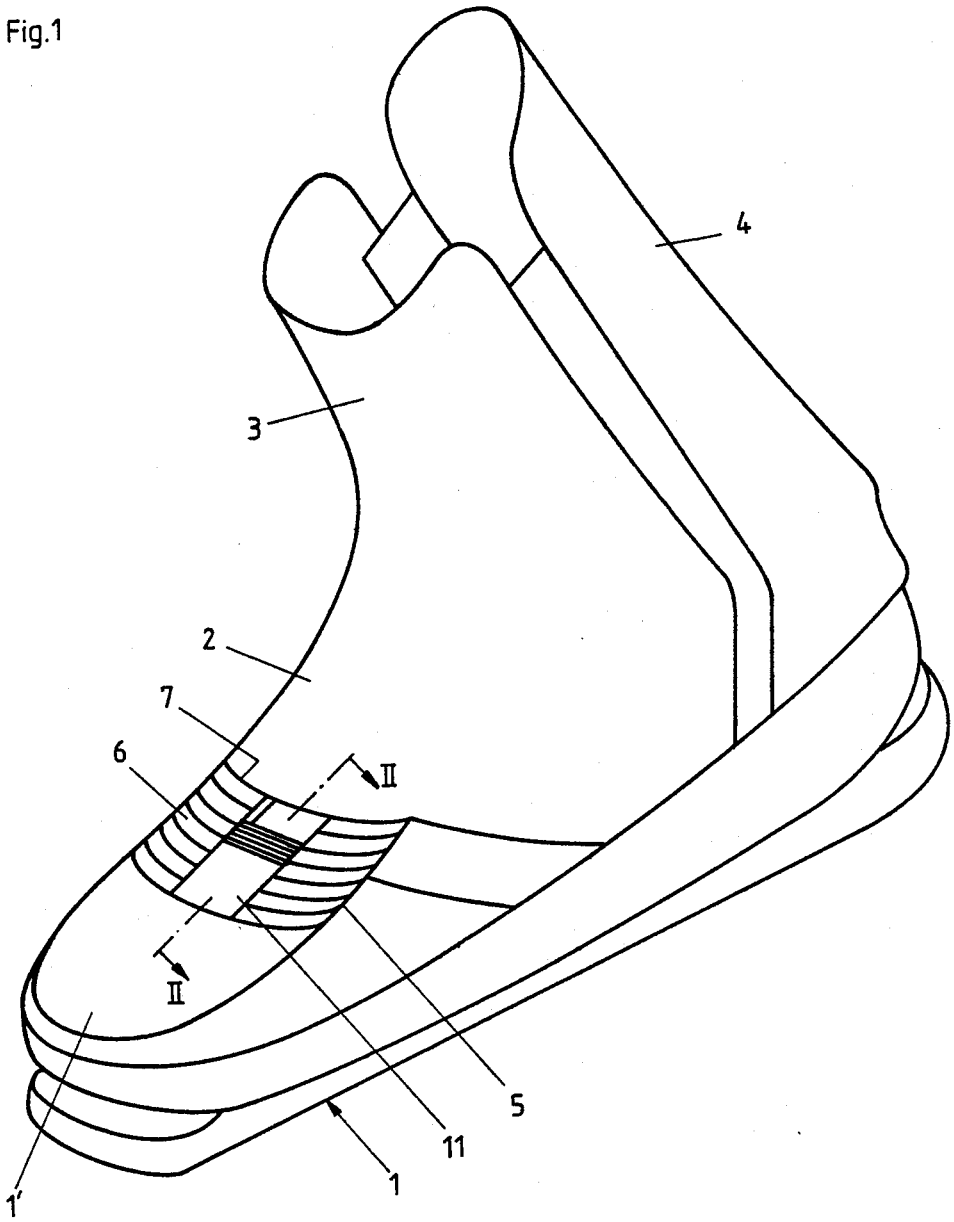

The skiing boot illustrated in FIG. 1 comprises a shell 1 with a tip 1' and a shield 2 covering the central region of the shell 1 and which in the heel region merges into a collar portion 3 which is open towards the rear and covered by a cover 4 which is pivotal rearwardly about a linkage, not illustrated in the ankle region in order to permit entry into the skiing boot from the rear. Along the upper side of the shell tip 1' a cutaway portion 5 is provided in which a cushion 6 of rubber, compressible plastics or the like is inserted, against which cushion 6, the front rim 7 of the shield 2 is supported, the latter being slightly adjustable in the walking direction in short slots of the shell 1 which are not illustrated.

In the transverse centre region of the shell 1 a base plate 8 fixed on the shell 1 in the cushion 6 is provided, the base plate comprising lateral guide means 9, 10 between which a slider 11 designed as a double armed toggle lever is mounted slidably in the longitudinal direction of the skiing boot. The slider 11 is pivotal about an edge 12 of a chamfer surface 13 in the direction of the double arrow A and is loaded by a spring 14 which bears on one side against the bottom of a bore 15 recessed in the chamfer surface 13 and on the other side against the head of a bolt 16, the shaft of which, enclosed by the spring 14, is seated in the bore 15. From the bottom of the slider 11 a projection 17 projects downwardly which is selectively engageable in either of two slots 18, 19 provided in the base plate 8, the spring 14 providing a bias to force the double lever-like slider 11 into the engaged position.

In addition the slider 11 comprises a projection 20 which engages below the shield 2.

Figure 2:
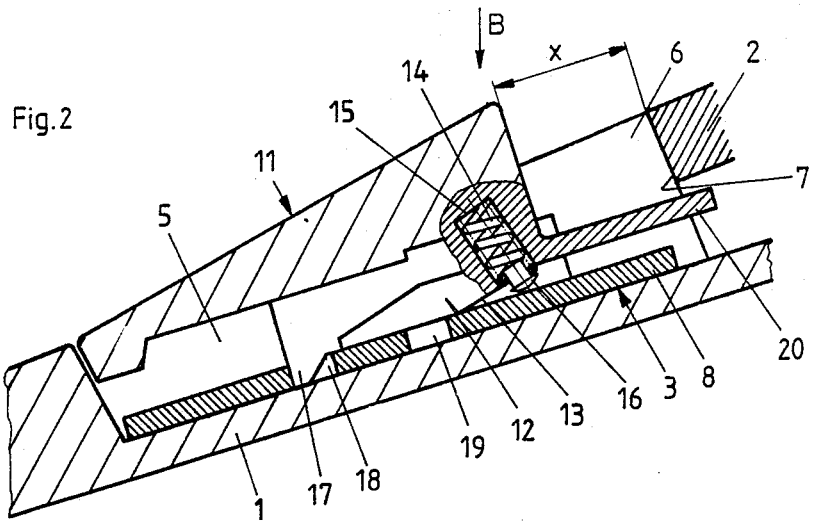

In the position illustrated in FIG. 2, the slider 11 with its projection 17 engages into the slot 18 which is furthest removed from the shield 2. In this terminal position, denoted as "soft", the shield 2 is able to slide and compress the cushion 6 over the greatest distance afforded to it by the distance "X" between the edge 7 of the shield and the stop surface 21 of the slider.

Figure 3:
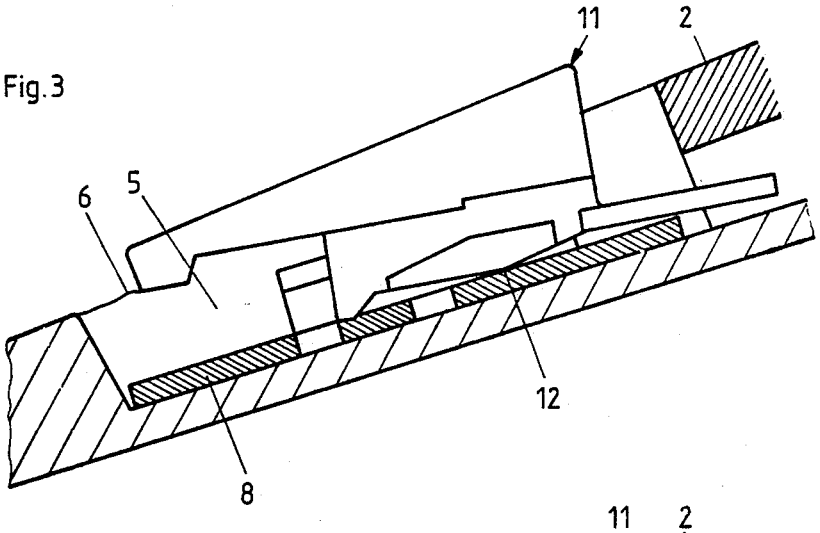
Figure 4:
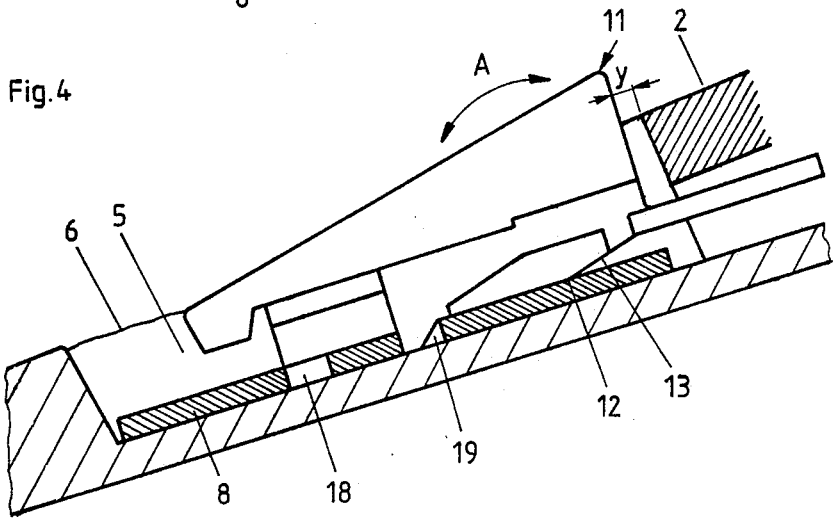
Figure 5:
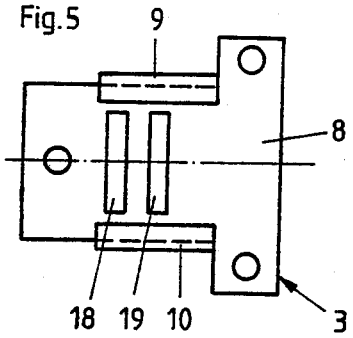
Figure 6:
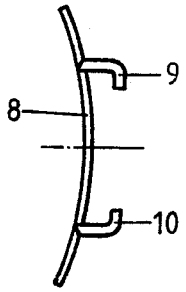

If the skier desires a harder setting of the boot, i.e. with the freedom of movement in the walking direction being diminished, he presses as indicated by arrow B in FIG. 2 against the rear portion of the slider 11 in opposition to the force of the spring 14 and swings the slider 11 into the position illustrated in FIG. 3 in which the projection 17 has left the slot 18, whereafter it displaces and disengages the slider 11 towards the rim 7 of the shield 2 as illustrated in FIG. 4 so that the projection 17 engages the rear slot 19. In this position of the slider 11 the skiing boot is adjusted "hard", i.e. the shield 2 can at the most be displaced by the small distance "Y".

It stands to reason that various costructional modifications are possible within the scope of the invention. Thus, it is possible to provide more than two slots 18, 19 so as to also permit intermediate positions of the slider 11.

What we claim is:

1. A ski boot having a shell which includes a toe cap, an instep shield merging into an upright collar which is open toward the rear of the boot, and a cover behind said collar, the instep shield being flexibly mounted for movement toward the toe cap and the boot including a resilient cushion between the toe cap and a forward edge of the instep shield wherein, for adjusting flexibility of the boot in a walking direction, by limiting said movement of the instep shield by selected amounts, the shell is provided with a position-adjustable stop between the toe cap and the forward edge of the instep shield, the stop being mounted for movement on a baseplate extending rearwardly from the toe cap and forward movement of the forward edge of the instep shield, the stop comprising a toggle lever having one arm adapted to engage selected ones of a plurality of longitudinally spaced adjustment formations on the baseplate and another arm provided with a spring for urging said one arm to engage said formations.

2. A ski boot as defined in claim 1 wherein the stop is located substantially centrally of said cushion.

3. A ski boot as defined in claim 1, wherein said adjustment formations comprise slots in the baseplate and wherein said one arm of the stop has a projection for engagement in said slots.

4. A ski boot as defined in claim 1 wherein the stop has a lower edge formed as a chamfer by which the stop is pivotally mounted on the baseplate.

5. A ski boot as defined in claim 1 wherein the stop has a rearward extension fitting under the instep shield.

* * * * *